US009591406B1

(12) United States Patent
Huang

(10) Patent No.: US 9,591,406 B1
(45) Date of Patent: Mar. 7, 2017

(54) MULTI-TRACK STEREO SOUND EARPHONE

(71) Applicant: Tien-Lai Huang, Taipei (TW)

(72) Inventor: Tien-Lai Huang, Taipei (TW)

( * ) Notice: Subject to any disclaimer, the term of this patent is extended or adjusted under 35 U.S.C. 154(b) by 0 days.

(21) Appl. No.: 15/137,405

(22) Filed: Apr. 25, 2016

(51) Int. Cl.

| | |
|---|---|
| ***H04R 5/02*** | (2006.01) |
| ***H04R 5/033*** | (2006.01) |
| ***H04R 1/10*** | (2006.01) |
| ***H04R 1/28*** | (2006.01) |

(52) U.S. Cl.
CPC ..... *H04R 5/033* (2013.01); *H04R 1/1008* (2013.01); *H04R 1/1016* (2013.01); *H04R 1/2807* (2013.01); *H04R 5/0335* (2013.01)

(58) Field of Classification Search
CPC ..... H04R 5/033; H04R 1/1008; H04R 1/1016
See application file for complete search history.

(56) References Cited

U.S. PATENT DOCUMENTS 5,109,424 A * 4/1992 Andre ..... H04R 1/1008 381/371
5,729,605 A * 3/1998 Bobisuthi ..... H04R 1/225 379/430
2013/0336512 A1* 12/2013 Kim ..... H04R 1/1016 381/380
2015/0016653 A1* 1/2015 Lu ..... H04R 1/2826 381/379
2015/0016660 A1* 1/2015 Matsumura ..... H04R 9/06 381/415
2015/0326974 A1* 11/2015 Skubinski, III ..... H04R 7/04 381/309
2016/0173989 A1* 6/2016 Jacques ..... H04R 7/04 381/419
2016/0210956 A1* 7/2016 Huang ..... G10K 11/1782
2016/0212521 A1* 7/2016 Huang ..... H04R 1/1008
2016/0330537 A1* 11/2016 Barrentine ..... H04R 1/1041

* cited by examiner

*Primary Examiner* — Simon King
(74) *Attorney, Agent, or Firm* — Chun-Ming Shih

(57) ABSTRACT

A multi-track stereo sound earphone includes an earphone main body, which includes a loudspeaker inside, a resonance cavity connected thereto, a sound hole plate, and a solid plate. The earphone main body further includes: at least a low sound hole, disposed in middle position of a lower encircling perimeter of the resonance cavity; at least a high sound hole, disposed in a middle position of an upper encircling perimeter of the resonance cavity; and a plurality of medium sound holes, disposed surrounding a sound hole plate in front of the loudspeaker. The solid plate is disposed in center of the sound hole plate, opposite to center of a vibration membrane of loudspeaker. The diameters of the plurality of medium sound holes decrease from bottom to top, and the plurality of medium sound holes are distributed around outer perimeter of the solid plate.

7 Claims, 8 Drawing Sheets

MULTI-TRACK STEREO SOUND EARPHONE

BACKGROUND OF THE INVENTION

Field of the Invention

The present invention relates to an earphone, and in particular to a multi-track stereo sound earphone having special design holes on the earphone main body, in achieving multi-track stereo sound effect.

The Prior Arts

Along with progress of science and technology, the development of audio-video electronic products is toward the trend of light weight, thin profile, and compact size, so that user may listen to music or view videos on all occasions more conveniently. In order that user may listen to music without disturbing other people nearby, the use of an earphone becomes indispensable. In this respect, the types of earphone are numerous, such as ear-hood type earphone, ear-hanging type earphone, head-binding type earphone, and ear-embedding earphone.

Therefore, the major function of an earphone, is to provide user a better music listening effect, to overcome the disturbance to the music coming from the surroundings, especially in a noisy surrounding or while taking exercise, such as working in a factory, driving a vehicle, playing balls, or jogging. In such cases, a user only has to put on an earphone, to avoid being affected by the outside environment.

However, in this respect, the conventional earphone still has much to be desired. For example, as shown in FIG. 8, for an ordinary earphone 50 of the Prior Art, its design is that, on a sound hole plate 51 is provided only with a plurality of holes 52 As such, it can only provide ordinary high-low sound, yet it is not capable of achieving high fidelity multi-track stereo sound effect, thus it can hardly meet the requirement of music fans.

Therefore, presently, the design and performance of the earphone is not quite satisfactory, and it leaves much room for improvement.

SUMMARY OF THE INVENTION

In view of the problems and drawbacks of the prior art, the present invention provides a multi-track stereo sound earphone, to overcome the shortcomings of the Prior Art.

The present invention provides a multi-track stereo sound earphone, comprising an earphone main body, which includes a loudspeaker inside, a resonance cavity connected thereto, a sound hole plate, and a solid plate. The earphone main body further includes: at least a low sound hole, disposed in a middle position of a lower encircling perimeter of the resonance cavity; at least a high sound hole, disposed in a middle position of an upper encircling perimeter of the resonance cavity; a plurality of medium sound holes, disposed surrounding a sound hole plate in front of the loudspeaker, a solid plate is disposed in a center of the sound hole plate, opposite to a center of a vibration membrane of the loudspeaker, diameter of the plurality of medium sound holes is decreased from bottom to top, and the plurality of medium sound holes are distributed around an outer perimeter of the solid plate. As such, the hole design of diameter of the low sound hole greater than that of the medium sound hole, which in turn greater than that of the high sound hole, is used to achieve multi-track stereo surround sound effect.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Refer to FIGS. 1 to 8 respectively for a front view of a multi-track stereo sound earphone according to a first embodiment of the present invention; a cross section view of a multi-track stereo sound earphone according to a first embodiment of the present invention; a perspective view of a multi-track stereo sound earphone according to a second embodiment of the present invention; an exploded view of a multi-track stereo sound earphone according to a second embodiment of the present invention; a front view of a loudspeaker according to a second embodiment of the present invention; a cross section view of a loudspeaker according to a second embodiment of the present invention; a schematic diagram of a multi-track stereo sound earphone worn by a user according to a second embodiment of the present invention; and a front view of a loudspeaker according to the Prior Art.

The present invention provides a multi-track stereo sound earphone, that can be realized as wire type earphone or wireless type earphone, such as ear-hanging type earphone, a head-binding type earphone, or an ear-hood type earphone. The difference among them is that, the size of sound holes can be varied depending on the size of earphone main body 10.

Figure 1:
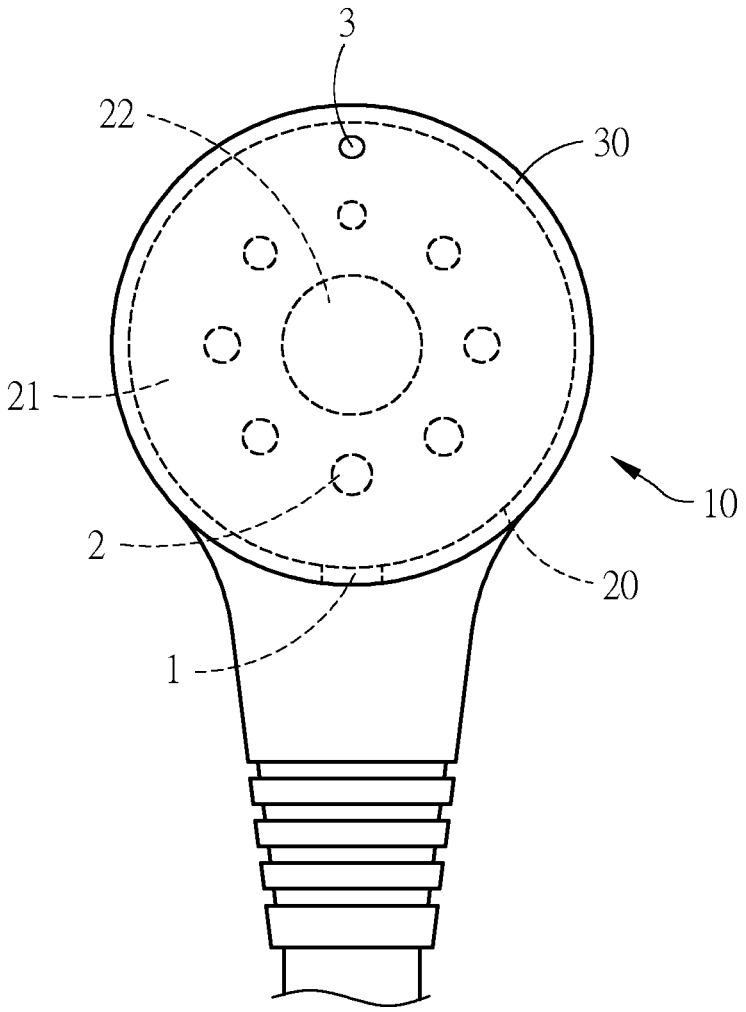
FIG. 1 is a front view of a multi-track stereo sound earphone according to a first embodiment of the present invention.
Figure 2:
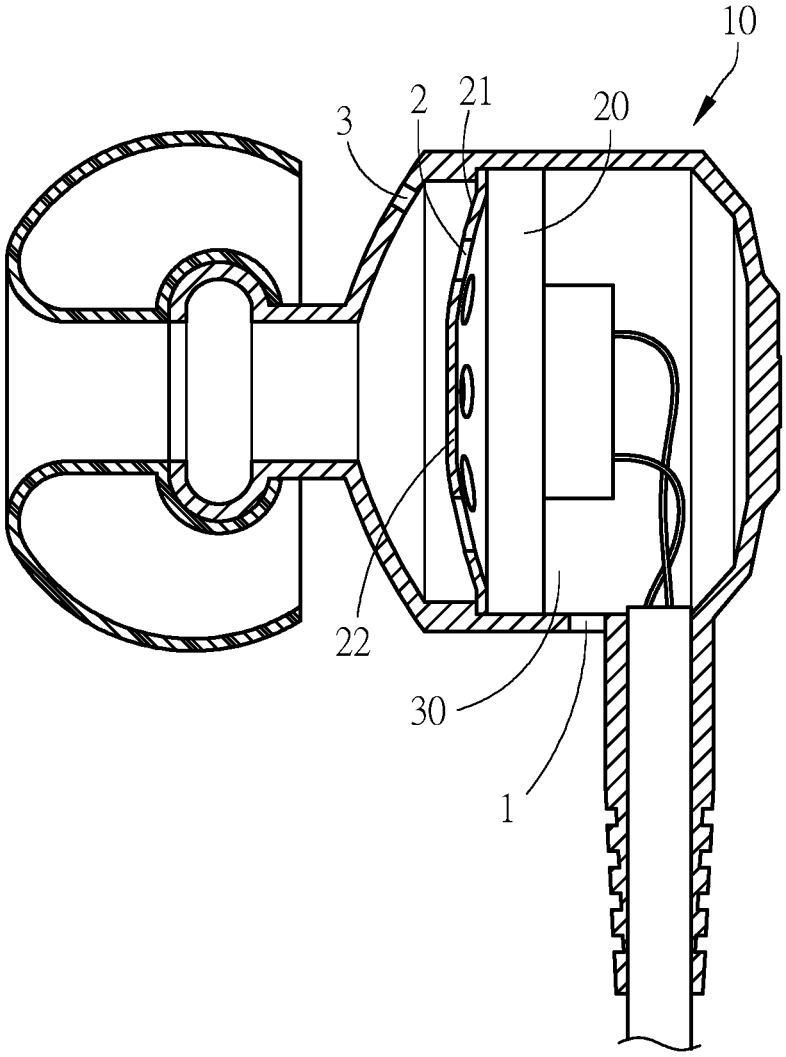
FIG. 2 is a cross section view of a multi-track stereo sound earphone according to a first embodiment of the present invention.
Figure 3:
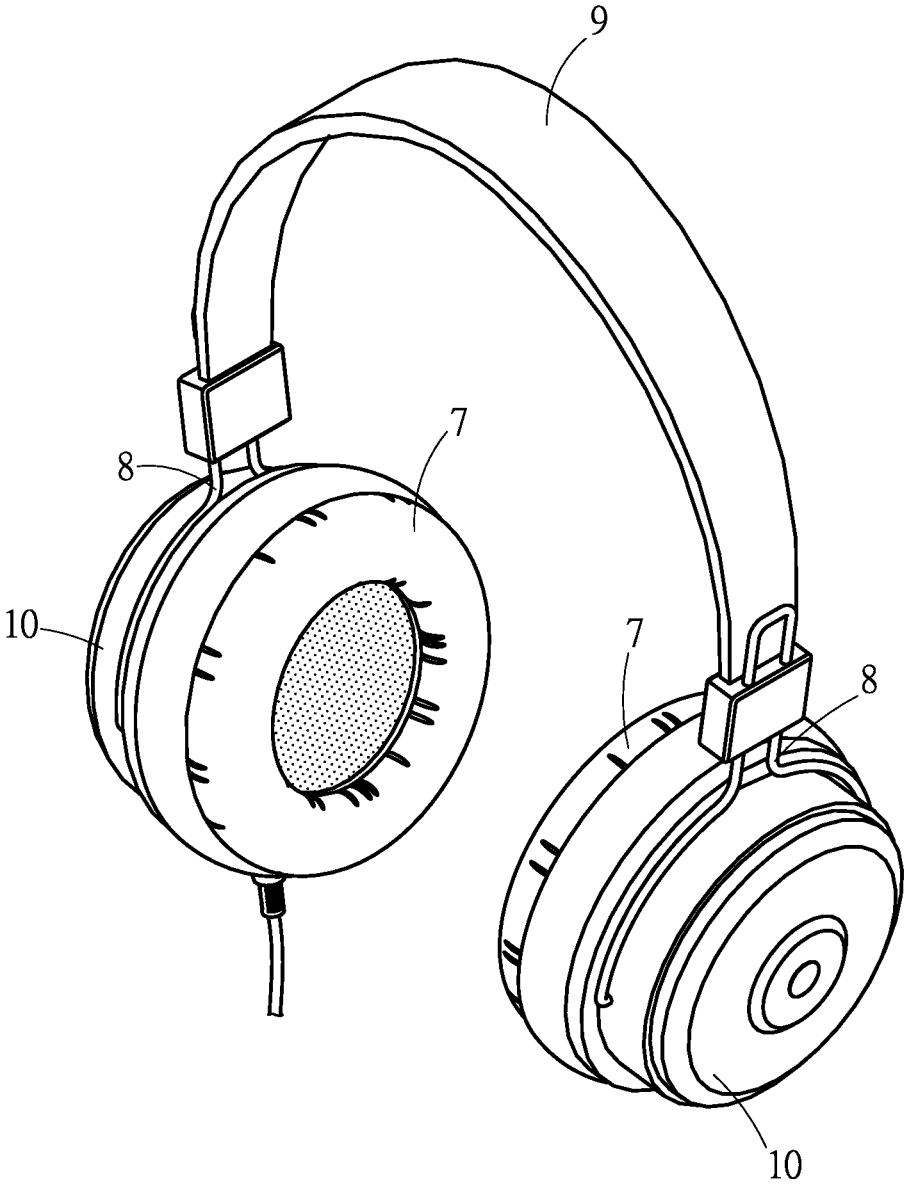
FIG. 3 is a perspective view of a multi-track stereo sound earphone according to a second embodiment of the present invention.

As shown in FIGS. 1 and 2, the earphone main body 10 includes a loudspeaker 20 inside, a resonance cavity 30 connected thereto, a sound hole plate 21, and a solid plate 22. The earphone main body 10 further includes: at least a low sound hole 1, disposed in a middle position of a lower encircling perimeter of the resonance cavity;

at least a high sound hole 3, disposed in a middle position of an upper encircling perimeter of the resonance cavity 30; and a plurality of medium sound holes 2, disposed surrounding a sound hole plate 21 in front of the loudspeaker 20, a solid plate 22 is disposed in a center of the sound hole plate 21, opposite to a center of a vibration membrane of the loudspeaker 20. The diameter of the plurality of medium sound holes decreases from bottom to top, and the plurality of medium sound holes are distributed around outer perimeter of the solid plate 22.

In application, the solid plate 22 can be an integral part of the earphone main body 10, or it can be a circular plate glued on additionally. The characteristic of the present invention is that, diameter of the low sound hole 1 is greater than that of the medium sound hole 2, which is in turn greater than that of the high sound hole 3. In this respect, an ear-embedding type earphone is taken as an example for explanation. Such an earphone is provided with a low sound hole of diameter Φ 1.5 mm~2.0 mm, a high sound hole 3 of diameter Φ 0.5 mm~0.6 mm, and a plurality of medium sound holes 2 of diameter Φ 1.0 mm~1.3 mm, while quantity of the medium sound hole is preferably 8~10.

As such, the special hole design containing a low sound hole 1, a plurality of medium sound holes 2, and a high sound hole 3, can be used to achieve multi-track stereo surround sound effect.

Figure 4:
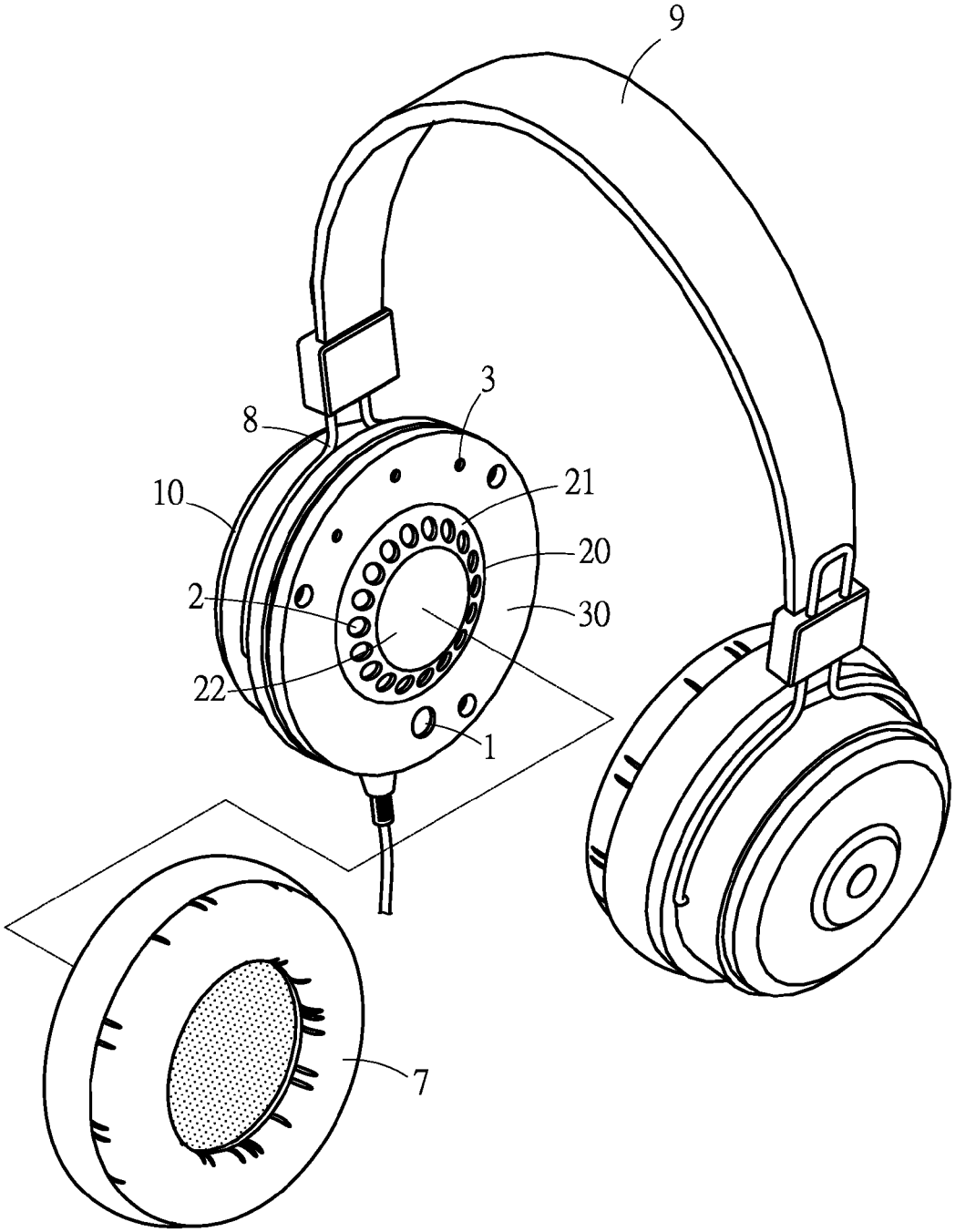
FIG. 4 is an exploded view of a multi-track stereo sound earphone according to a second embodiment of the present invention.
Figure 5:
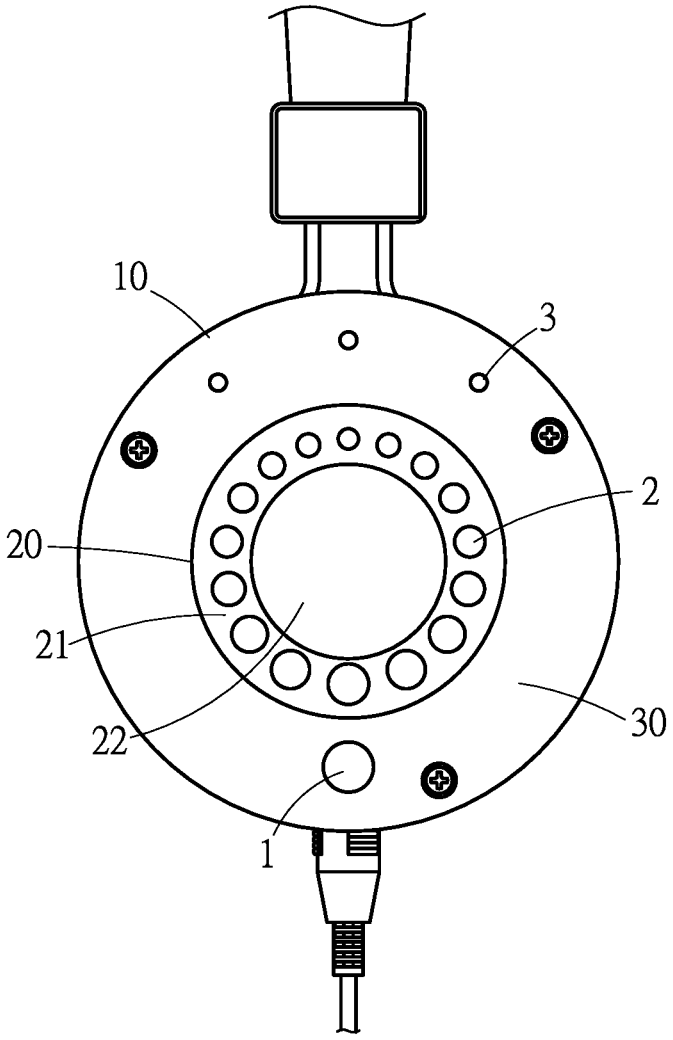
FIG. 5 is a front view of a loudspeaker according to a second embodiment of the present invention.

In addition, according to an embodiment of the present invention, the present invention can be implemented as an ear-hanging type earphone, a head-binding type earphone, or an ear-hood type earphone. Wherein, the diameter of the low sound hole 1 is Φ 3.0 mm~7.0 mm; the diameter of the high sound hole 3 is Φ 1.0 mm~2.0 mm, having a quantity of 2~5 (3 high sound holes 3 as shown in FIGS. 4 and 5), and are distributed in a middle portion of an upper encircling perimeter of the resonance cavity 30, and at positions on its both sides forming an angle with a center line; and the diameter of the plurality of medium sound hole 2 is Φ 2.0 mm~4.5 mm, while quantity of the medium sound hole is 8~20.

Then, refer to FIGS. 3 to 6, which show an ear-hood type earphone, having a head band 9, and two support arms 8 each disposed at each of two ends of the head band 9, for installing an earphone main body 10 having two ear hoods 7. This type of ear-hood type earphone has the advantages of providing stereo sound of excellent quality, and can be worn comfortably by the user, so it is preferred by the user, but the present invention is not limited to this. For the ear-hood type earphone, the diameter of the low sound hole 1 is Φ 6.0 mm, diameter of the high sound hole 3 is Φ 1.5 mm, while quantity of the high sound hole 3 is 3, distributed at a middle position of the upper encircling parameter, and at positions on both its sides forming an angle of 30 degrees with a center line, while quantity of the medium sound holes 2 is 16. The diameter of a single medium sound hole 2 above the solid plate is Φ 2.0 mm, the diameter of the single medium sound hole 2 below the solid plate is Φ 4.0 mm, the diameters of the medium sound holes 2 surrounding both sides of the solid plate 22 from bottom to top decrease sequentially by Φ 0.125 mm, while the diameter of the medium sound holes 2 near center of the solid plate 22 and on its both sides is Φ 3.0 mm (namely, the average hole diameter).

Figure 6:
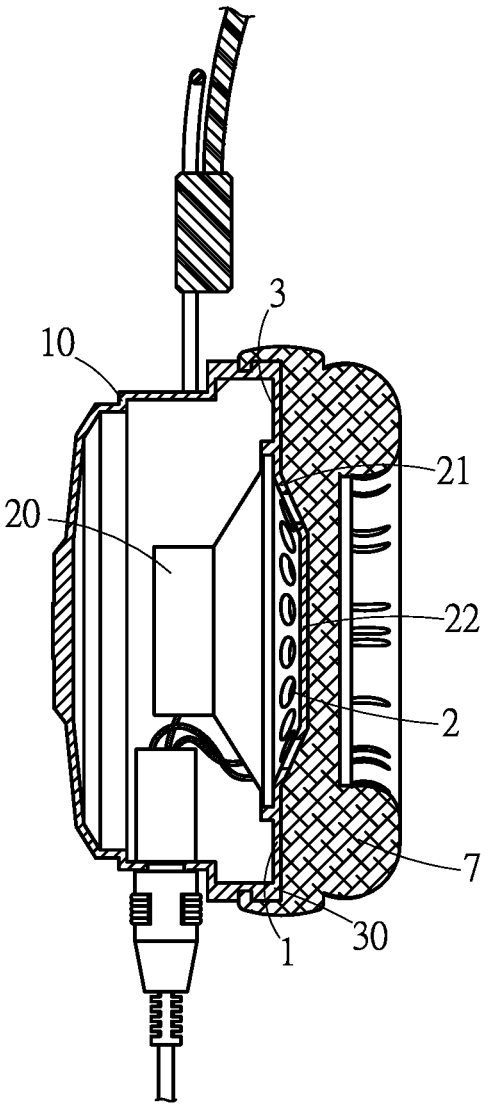
FIG. 6 is a cross section view of a loudspeaker according to a second embodiment of the present invention.
Figure 7:
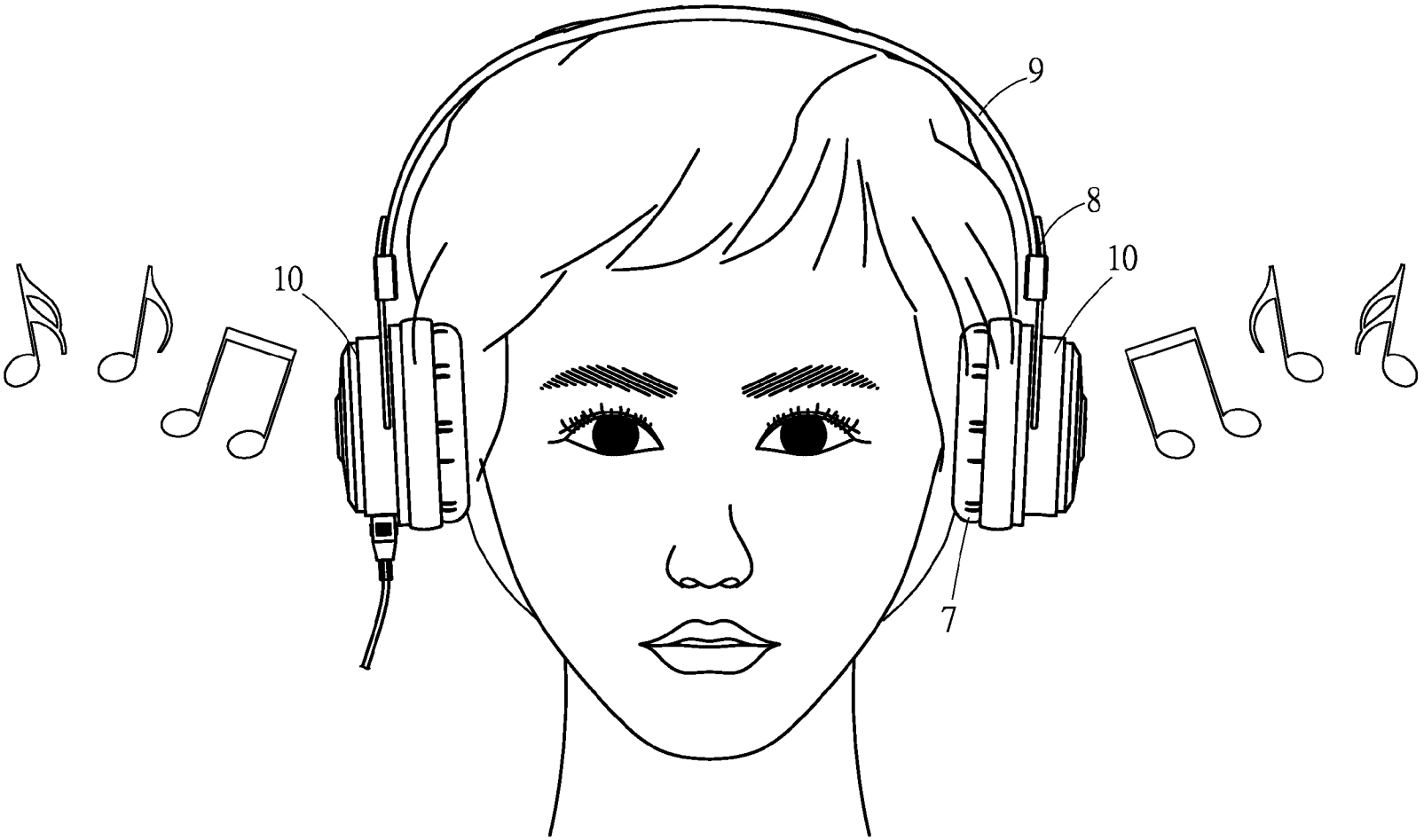
FIG. 7 is a schematic diagram of a multi-track stereo sound earphone worn by a user according to a second embodiment of the present invention.
Figure 8:
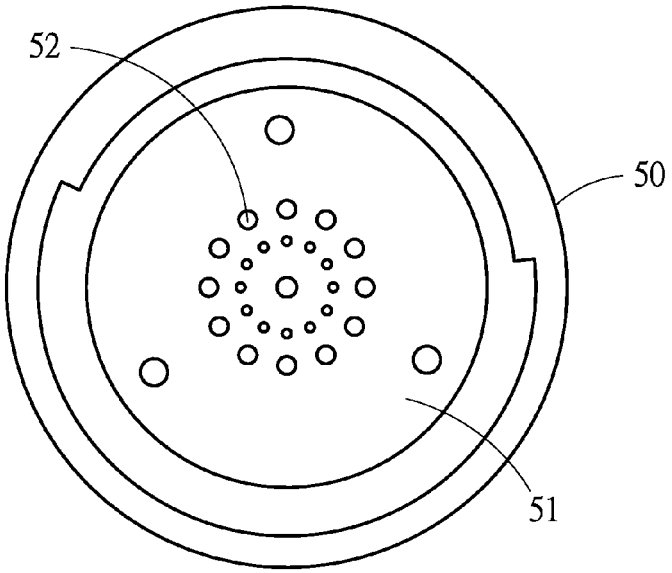
FIG. 8 (Prior ART)
FIG. 8 is a front view of a loudspeaker according to the Prior Art.

Summing up the above, as shown in FIGS. 6 and 7, on the earphone main body 10, the low sound holes 1, the high sound holes 3, and the medium sound holes 2 are formed into multi-tracks, so that the output low sound, high sound, and medium sound are merged in the user's ear, to achieve multi-track stereo surround sound effect.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A multi-track stereo sound earphone, comprising an earphone main body, which includes a loudspeaker inside, a resonance cavity connected thereto, a sound hole plate, and a solid plate;

characterized in that, the earphone main body further includes:

at least a low sound hole, disposed in a middle position of a lower encircling perimeter of the resonance cavity;

at least a high sound hole, disposed in a middle position of an upper encircling perimeter of the resonance cavity; and a plurality of medium sound holes, disposed surrounding the sound hole plate in front of the loudspeaker, wherein a solid plate is disposed in a center of the sound hole plate, opposite to a center of a vibration membrane of the loudspeaker, diameter of the plurality of medium sound holes is decreased from bottom to top, and the plurality of medium sound holes are distributed around an outer perimeter of the solid plate, such that a hole design of diameter of the low sound hole greater than that of the medium sound hole, which in turn greater than that of the high sound hole, is used to achieve multi-track stereo surround sound effect.

2. The multi-track stereo sound earphone as claimed in claim 1, wherein the multi-track stereo sound earphone is selected from a wireless earphone and a wire earphone.

3. The multi-track stereo sound earphone as claimed in claim 2, wherein the multi-track stereo sound earphone is of an ear-embedding type, having the low sound hole of a diameter Φ 1.5 mm-2.0 mm, the high sound hole of the diameter Φ 0.5 mm-0.6 mm, and a plurality of medium sound holes of the diameter Φ 1.0 mm-1.3 mm, while quantity of the medium sound hole is 8-10.

4. The multi-track stereo sound earphone as claimed in claim 2, wherein the multi-track stereo sound earphone is selected from one of a group consisting of an ear-hood type earphone, an ear-hanging type earphone, and a head-binding type earphone.

5. The multi-track stereo sound earphone as claimed in claim 2, wherein the diameter of the low sound hole is Φ 3.0 mm-7.0 mm, the diameter of the plurality of medium sound hole is Φ 2.0 mm-4.5 mm, while quantity of the medium sound hole is 8-20, and the diameter of the high sound hole is Φ 1.0 mm-2.0 mm, having a quantity of 2-5, and are distributed in a middle portion of the upper encircling perimeter of the resonance cavity, and at positions on its both sides forming an angle with a center line.

6. The multi-track stereo sound earphone as claimed in claim 5, wherein the diameter of the low sound hole is Φ 6.0 mm, the diameter of the high sound hole is Φ 1.5 mm, while quantity of the high sound hole is 3, distributed at a middle position, and at positions on both its sides forming an angle of 30 degrees with a center line, while quantity of the medium sound holes is 16, the diameter of a single medium sound hole above the solid plate is Φ 2.0 mm, the diameter of the single medium sound hole below the solid plate is Φ 4.0 mm, the diameters of the medium sound holes surrounding both sides of the solid plate from bottom to top decrease sequentially by Φ 0.125 mm, while the diameter of the medium sound hole near center of the solid plate and on its both sides is Φ 3.0 mm.

7. The multi-track stereo sound earphone as claimed in claim 6, wherein the multi-track stereo sound earphone is an ear-hood type earphone, including an earphone main body having two installed ear hoods, a head band, and two support arms, each disposed at each of two ends of the head band.

* * * * *